US005599242A

United States Patent [19]

Solviche et al.

[11] Patent Number: 5,599,242

[45] Date of Patent: Feb. 4, 1997

[54] GOLF CLUB SHAFT AND CLUB INCLUDING SUCH SHAFT

[75] Inventors: Serge Solviche, Annecy, France; Benoît Vincent, Leucadia, Calif.; Bénédicte Beau, Ceyzerieu, France

[73] Assignee: Taylor Made Golf Company, Inc., Carlsbad, Calif.

[21] Appl. No.: 596,044

[22] Filed: Feb. 6, 1996

[30] Foreign Application Priority Data

Feb. 13, 1995 [FR] France ..... 95 01809

[51] Int. Cl.[6] ..... A63B 53/10

[52] U.S. Cl. ..... 473/318; 473/319; 273/DIG. 23

[58] Field of Search ..... 473/316, 317, 473/318, 319, 320, 321, 322, 323, 300, 256, 370; 273/DIG. 7, DIG. 23, DIG. 15, 67 DA, 73 G, 73 J, 73 K, 67 R, 72 R, 72 A, 67 A

[56] References Cited

U.S. PATENT DOCUMENTS

| | | | |
|---|---|---|---|
| 2,130,395 | 9/1938 | Lard | 473/318 |
| 2,236,414 | 3/1941 | Reach | 473/321 |
| 3,166,319 | 1/1965 | Brilhart . | |
| 3,646,610 | 2/1972 | Jackson | 473/319 |
| 3,998,458 | 12/1976 | Inoue | 473/319 |
| 4,000,896 | 1/1977 | Lauraitis | 473/319 |
| 4,135,035 | 1/1979 | Branen | 473/319 |
| 4,319,750 | 3/1982 | Roy | 273/DIG. 7 |
| 4,983,242 | 1/1991 | Reed . | |
| 5,088,735 | 2/1992 | Shigetoh | 473/320 |
| 5,156,396 | 10/1992 | Akatsuka | 473/319 |
| 5,265,872 | 11/1993 | Tennent et al. . | |
| 5,277,423 | 1/1994 | Artus . | |
| 5,333,857 | 8/1994 | Lallemand | 273/67 A |
| 5,437,450 | 8/1995 | Akatsuka | 473/319 |

FOREIGN PATENT DOCUMENTS

| | | |
|---|---|---|
| 0531233 | 3/1993 | European Pat. Off. . |
| 2670120 | 6/1992 | France . |
| 2250466 | 6/1992 | United Kingdom . |
| 2259861 | 3/1993 | United Kingdom . |

*Primary Examiner*—Sebastiano Passaniti
*Attorney, Agent, or Firm*— Greenblum & Bernstein, P.L.C.

[57] ABSTRACT

The invention relates to a shaft for a golf club, or to a club equipped with such a shaft. On at least 30% of the length of the shaft, its peripheral wall includes at least two layers, i.e., a first layer made of a material of density (ρ1) and of longitudinal Young's modulus (E1), and a second layer made of a material of density (ρ2) and of longitudinal Young's modulus (E2), the first and second layers being separated by a separation layer made of a substantially isotropic material having a density (ρ3) and a longitudinal Young's modulus (E3), the densities (ρ1, ρ2) of the materials of the first and second layers being greater than the density (ρ3) of the material of the separation layer, the longitudinal Young's moduli (E1, E2) of the materials of the first and second layers being respectively greater than 20 GPa, and the longitudinal Young's modulus (E3) of the material of the separation layer being lower than 20 GPa.

16 Claims, 5 Drawing Sheets

GOLF CLUB SHAFT AND CLUB INCLUDING SUCH SHAFT

BACKGROUND OF THE INVENTION

1. Field of the Invention

The present invention is related to the field of golf clubs and, in particular, to club shafts.

2. Description of Background and Relevant Information

A golf club comprises three main portions, namely, a handle or grip, a shaft, and a head. The shaft can be manufactured in materials such as wood, plastic, metal, or composite materials.

For the purpose of increasing its weight, golf club shafts are more and more often manufactured with the help of tubes made of metal or of composite materials.

The shafts of composite materials, or "composite shafts," are much appreciated by players for the following reasons:

they are lighter than metallic shafts, their rigidity is easy to optimize as a result of their mode of fabrication.

The gain in mass, obtained by using a composite shaft in place of a metallic shaft, allows the value of this gain to be added to the head for a given club mass. As a result, the impact force on a ball is increased.

The stiffness, most often variable along the shaft, can be optimized by modifying the thickness of the tube in appropriate areas.

In this manner, the flexion of the shaft during a movement of striking the ball will be such that it improves the restitution of the energy contained in the club at the moment of impact.

However, the known composite shafts have the enormous disadvantage of being fragile. The player frequently breaks the club shaft, particularly when the head hits the ground during a striking movement, generally called the "swing."

The swing is a very rapid motion that explains why the forces exerted on the club upon impact are very substantial.

The weight gain on the shaft results in a reduction in the thickness of the tube. The optimization of the stiffness, likewise, results in localized reductions of the thickness of the tube.

It follows that a high-performance composite shaft is fragile and breaks more rapidly than a steel shaft.

The player is therefore obliged to replace his or her equipment more often, which becomes very expensive. Manufacturers have tried to remedy these disadvantages by combining layers of different composite materials and by orienting these layers along selected directions to form the thickness of the tubes. However, the resulting very light shafts are very flexible, but still very fragile.

SUMMARY OF THE INVENTION

An object of the present invention is exactly to propose a new shaft combining the qualities of lightness, flexibility, and solidity.

A golf club shaft according to the invention is formed by an elongated tube extending along an axis, the tube being demarcated by an exterior surface, an interior surface, an end called the "tip" adapted to be affixed to a golf head, and an end called the "butt" adapted to be affixed to a handle or grip, a certain thickness separating the exterior surface from the interior surface to form a peripheral wall comprising a plurality of layers of material.

On at least 30% of the length of the tube of the shaft according to the invention, the peripheral wall comprises at least two layers, a first layer made of a material with a density $\rho 1$ and of a longitudinal Young's modulus E1, and a second layer made of a material with a density $\rho 2$ and a longitudinal Young's modulus E2. The first and second layers are separated by a separation layer made of a substantially isotropic material having a density $\rho 3$ and a longitudinal Young's modulus E3, the densities $\rho 1$ and $\rho 2$ of the materials of the first and second layers being greater than the density $\rho 3$ of the material of the separation layer. The longitudinal Young's moduli E1 and E2 of the materials of the first and second layers are respectively greater than 20 GPa, and the longitudinal Young's modulus E3 of the material of the separation layer is lower than 20 GPa.

More particularly, the densities $\rho 1$, $\rho 2$ of the materials of the two first layers of the shaft according to the invention are greater than 1.2 kg/dm$^3$ and the density $\rho 3$ of the material of the separation layer is lower than 1.2 kg/dm$^3$.

By a surprising effect, such a structure contributes both to lighten the shaft and to render it more solid.

Without negatively affecting the increase in solidity, one can provide that on at least one portion of the tube, the thickness of the layer of material whose density is less than 1.2 kg/dm$^3$ varies.

The advantage is that one can exploit a gain in mass or modify the stiffness of the shaft or, yet, do both at the same time.

The invention is likewise related to a golf club comprising a shaft according to the invention.

BRIEF DESCRIPTION OF THE DRAWINGS

Other characteristics and advantages of the invention will be better understood upon reading the description that follows and with reference to the annexed drawings giving, by way of example, several embodiments applied to a ski boot.

DETAILED DESCRIPTION OF THE PREFERRED EMBODIMENTS

Figures 1, 2:
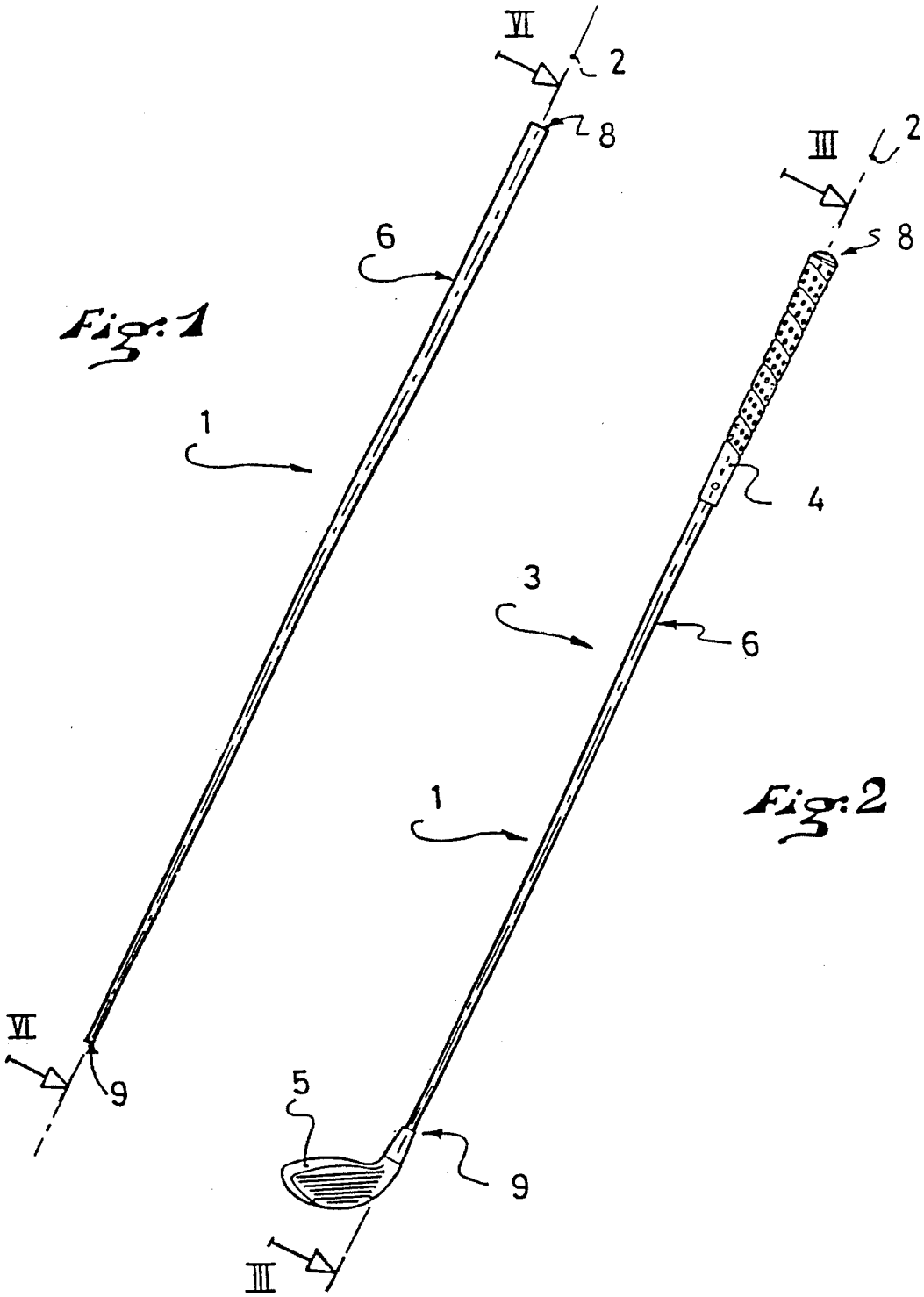
FIG. 1 shows a shaft lengthwise.
FIG. 2 shows a club assembled from the shaft of FIG. 1.

FIG. 1 represents a shaft 1 that can be a traditional shaft as well as a shaft according to the invention.

The shaft 1 has the aspect of a substantially straight shaft that extends along an axis 2.

As shown in FIG. 2, a golf club 3 is formed when one assembles, on one hand, a handle or grip 4 to one end 8, called the "butt," of the shaft 1, and on the other hand, a head 5 to the other end 9 called "tip," on the shaft 1.

Figure 3:
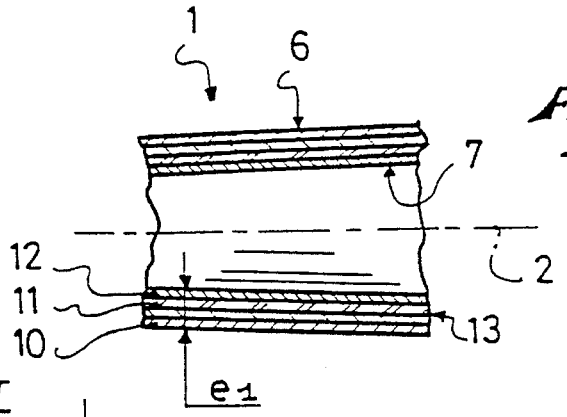
FIG. 3 is a partial cross-section taken along line III—III of FIG. 2 in the case of a conventional shaft.

In the case where the shaft 1 is a conventional shaft, its structure is similar to that represented in FIG. 3; the shaft 1 is a hollow tube comprising an exterior surface 6 and an interior surface 7. The ends of the shaft are, as aforesaid, the butt 8 and the tip 9, visible in the other figures.

The diameter of the tube 1 is substantially greater on the side of the butt 8 than on the side of the tip 9. The section of the exterior surface 6 of the tube 1 is a circle whose diameter varies as a function of the length of the tube 1. Likewise, the section of the interior surface 7 of the tube 1 is a circle whose diameter varies as a function of the length of the tube.

A conventional shaft 1, for example, can comprise three layers of carbon fiber cloth 10, 11, 12 forming a peripheral wall 13 with a thickness e1. Of course, the number of layers and the nature of the material constituting the fibers are only given by way of example. There are many other embodiments.

Figure 4:
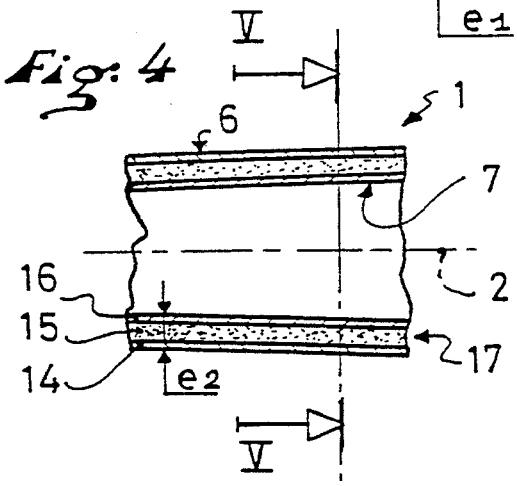
FIG. 4 is similar to FIG. 3 but corresponds to a shaft according to the invention.

FIG. 4 is a partial cross-section, lengthwise, of a shaft 1 according to the invention; this cross-section shows the structure of the shaft 1 according to a preferred, but non-limiting, embodiment.

Over at least 30% of the length of the shaft 1, at least two layers 14, 16 of a material with a density greater than 1.2 kg/dm$^3$, separated by another layer 15 of a material with a density lower than 1.2 kg/dm$^3$, form a peripheral wall 17 with a thickness e2.

Figure 5:
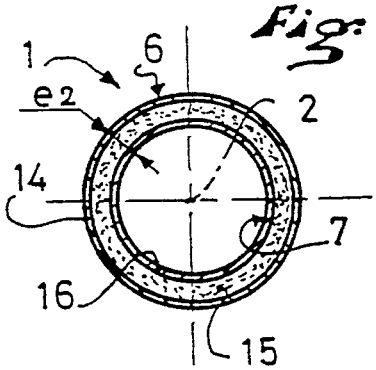
FIG. 5 is a cross-section taken along line V—V of FIG. 4.

Preferably, as is shown in FIG. 5, the shaft 1 has a structure such that any section of the tube is circular regardless of the area where it is considered between the butt 8 and the tip 9.

According to a preferred embodiment, the thickness e2 of the peripheral wall 17 is constant.

The material whose density is greater than 1.2 kg/dm$^3$ is preferably a composite material formed by carbon and resin fibers. But one can also use fibers of aramid, glass, or the like.

This material has a longitudinal Young's modulus E1 greater than 20 GPa. The longitudinal modulus E1 must be understood as being the modulus along the length of the shaft 1, independent of the orientation that can be given to the fibers.

To facilitate the graphic representation, the layers 14 and 16 of the composite material are symbolized by two solid lines separated by a hatching. However, these layers 14 and 16 must be considered as being either single layers each having a single thickness or a stacks of several thinner layers.

Furthermore, to facilitate the description of the invention, reference is made to two layers 14 and 16 made of a similar material.

However, without leaving the scope of the invention, one can use two layers 14 and 16 made of two distinct materials.

For example, the external layer 14 can be of carbon and resin fibers whereas the internal layer 16 is of glass and resin fibers.

In this case, these layers each have an inherent density greater than 1.2 kg/dm$^3$ and an inherent longitudinal Young's modulus greater than 20 GPa.

The material whose density is lower than 1.2 kg/dm$^3$ is preferably a foam of a plastic material, but one can also use a synthetic or natural resin, cork, wood, or the like. This material has a longitudinal Young's modulus E3 lower than 20 GPa.

The foam of synthetic material is obtained, for example, from a mixture containing a basic product and a foaming agent, according to processes well known by one skilled in the art.

Figure 6:
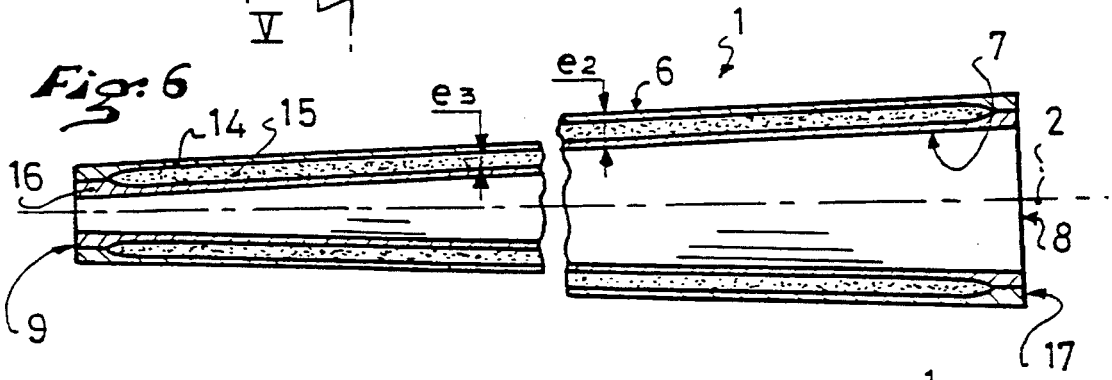
FIG. 6 is a cross-section taken along line VI—VI of FIG. 1 in the case of a shaft according to the invention.

FIG. 6 is a longitudinal cross-section of shaft 1 according to the invention.

The total length of the portion of the tube 1, in which the peripheral wall comprises at least two layers of composite material 14, 16 separated by a layer of foam 15, is at least equal to 30% of the length of the tube.

Any exterior diameter, measured from a given distance from the tip or from the butt on a shaft 1 according to the invention, is substantially identical to the diameter measured in the same area on a conventional shaft.

It is for this reason that the structure of shaft 1 according to the invention is very light; this layer of foam 15 with thickness e3 has a reduced density with respect to that of the composite material. One has in fact replaced a portion of the composite material by the foam.

If one compares the shaft 1 to a beam whose neutral fiber is the axis 2, one notices that the replacement of a layer of composite materials by the foam has almost not changed the inertia characteristics of the shaft 1.

The foam also makes it possible to diminish, in a continuous and uniform manner, the distribution of stiffness of the shaft.

The new qualities of lightness and flexibility of the shaft 1 make it more capable of absorbing the energy due to the shock of the head 5 of the club 3 on a ball or on the ground. The shaft ruptures are, advantageously, much more rare.

The layers of composite material 14, 16, and of foam 15 can be juxtaposed side by side; however, it is preferable that these different layers 14, 15, 16 forming the peripheral wall 17 of the tube 1 be glued on each other.

In effect, a gluing has the advantage of preventing a relative sliding of the layers with respect to each other.

For better cohesion, the layer of foam 15 stops before the ends 8 and 9 of the shaft 1, in a manner that layers of composite material 14, 16 can be glued directly on each other. The preferred embodiment, given by way of non-limiting example, advantageously makes it possible to avoid the problems of possible separation of the layers.

Figure 7:
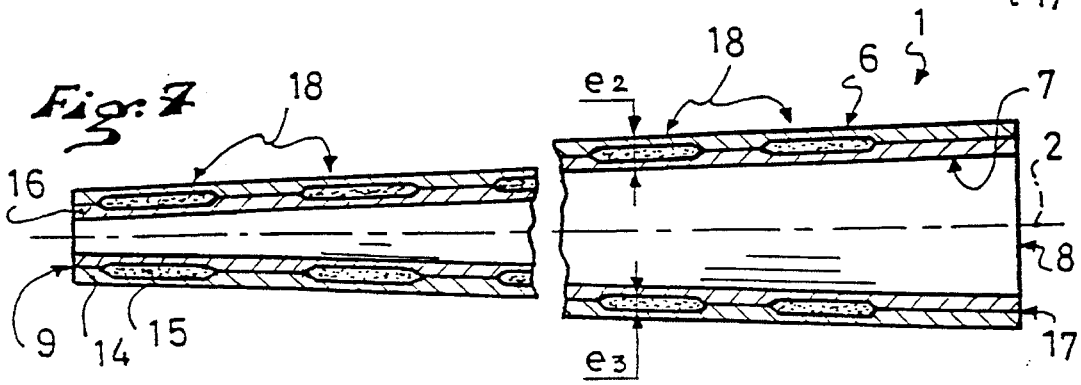
FIG. 7 is a further embodiment.

A varied embodiment is illustrated in FIG. 7.

The layer of foam 15 is interrupted at least once on the length of the shaft 1 to form several successive sections 18. Each section 18 constitutes a zone lightened by the presence of foam 15 that replaces the composite material 14, 16.

An alternation of zones comprising the foam 15 with zones without foam can help to modify the rigidity of the shaft 1 while lightening and reinforcing it.

One can also vary the rigidity or the flexibility of the shaft 1 by arranging zones of the shaft 1 where the structure varies, as is shown on a few examples represented in FIGS. 8–11.

Figure 8:
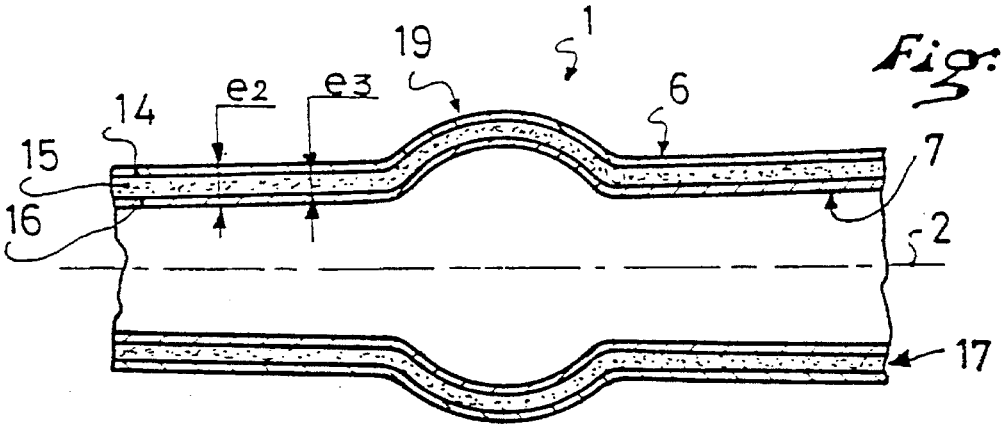
FIG. 8 is an example of a variation of a shaft's profile.

FIG. 8 is a partial longitudinal cross-section of the shaft 1, showing a variation of the profile or section of the shaft 1. The thickness e2 of the peripheral wall 17 is substantially constant. The section of the shaft 1 increases uniformly to form a convex portion 19.

One can preferably position and size the convex portion 19 to obtain a variation in the rigidity of the shaft 1 in desired areas.

Figure 9:
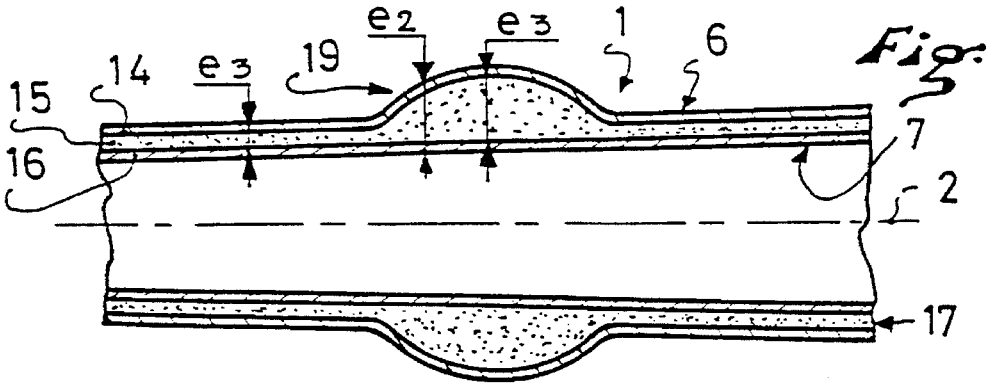
FIG. 9 is an example of a variation in the thickness of the layer of material whose density is lower than 1.2 kg/dm$^3$.

FIG. 9 is a variation of FIG. 8 where the convex portion 19 is obtained by varying the thickness e2 of the peripheral wall 17. The thickness e3 of the foam 15 increases at the level of the convex portion 19.

Figure 10:
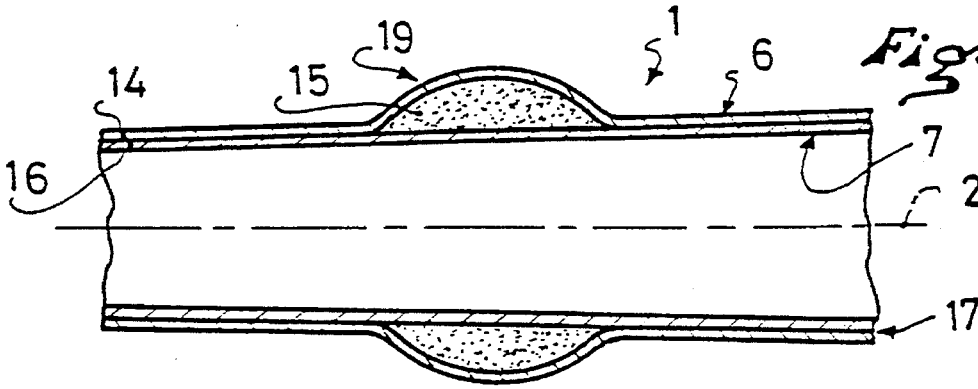
FIG. 10 is another embodiment.

FIG. 10 is similar to FIG. 9, but the layer of foam 15 is interrupted on both sides of the convex portion 19.

Figure 11:
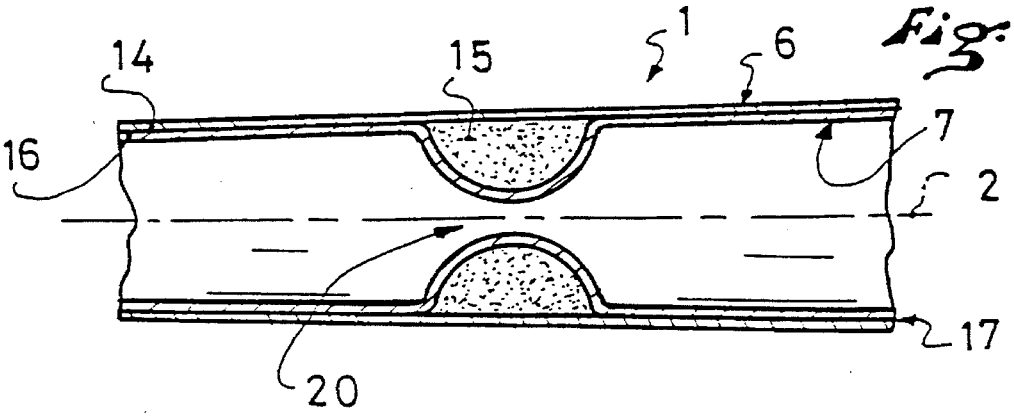
FIG. 11 is still another embodiment.

FIG. 11 is another variation in which the foam 15 is interposed between the layers of composite material 14, 16 to form an internal narrowing 20 of the tube 1.

Other examples can also be contemplated within the scope of the present invention.

However, in any case, the total length of the shaft 1 comprising a thickness of foam interposed between two layers of composite material is equal to at least 30% of the length of the shaft 1.

Figure 12:
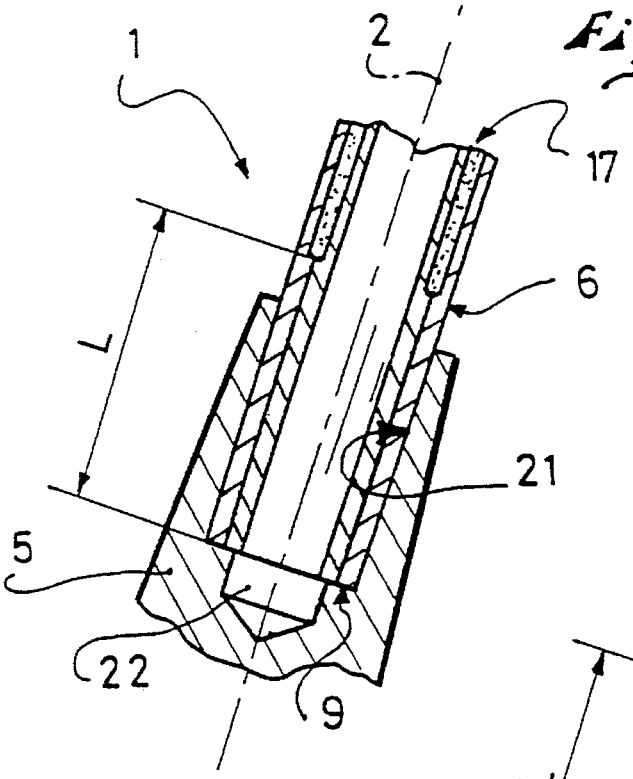
FIG. 12 is an example of the connection between the shaft and the head.
Figure 13:
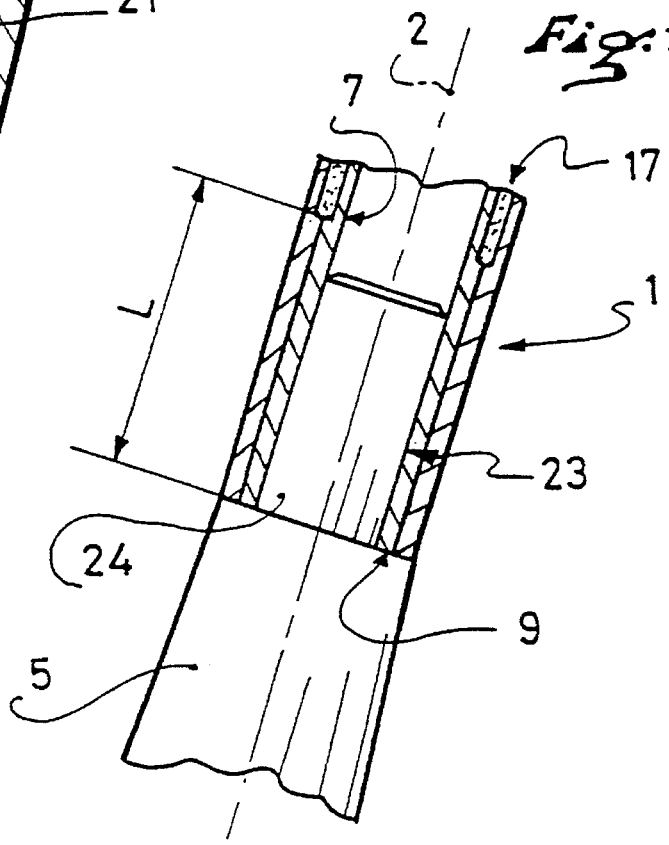
FIG. 13 is a variation of the connection of FIG. 12.

As is shown in FIGS. 12 and 13, the shaft 1 can be assembled to the head in two possible manners.

A first possibility shown in FIG. 13 consists of gluing the exterior surface 6 of the shaft 1 against an interior wall 21 of a hole 22 provided in the head 5.

A second possibility shown in FIG. 13 consists of gluing the interior surface 7 of the shaft 1 against to an exterior wall 23 of a cog 24 affixed to the head 5.

In the two cases, as aforesaid, it is desirable that the layers of composite material be directly affixed to each other in the vicinity of the tip 9. This structure avoids any problem of delamination of the different layers of the peripheral wall 17.

For example, one can provide that in the vicinity of the tip 9, the tube 1 has a wall 17 whose thickness e2 comprises only one or several layers of composite material, over a distance L of 300 millimeters from tip 9.

Figure 14:
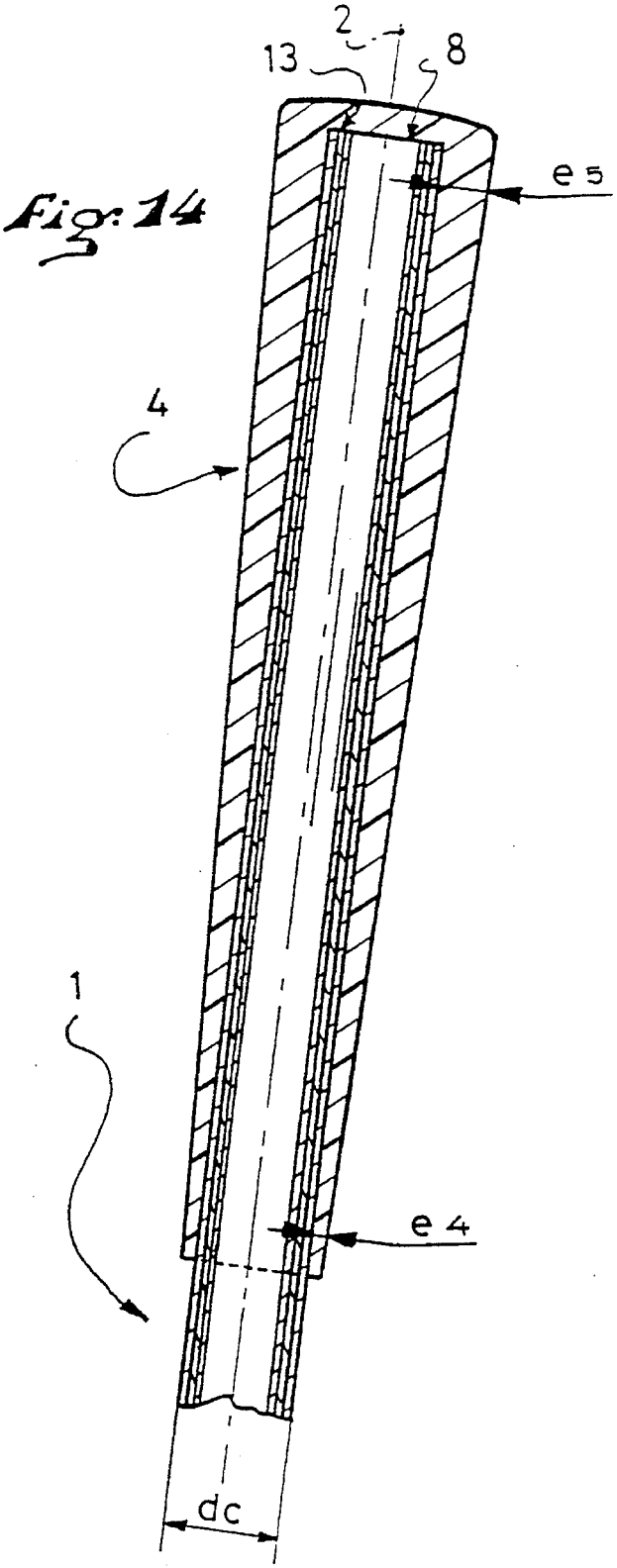
FIG. 14 is a conventional mounting of a grip on a shaft.
Figure 15:
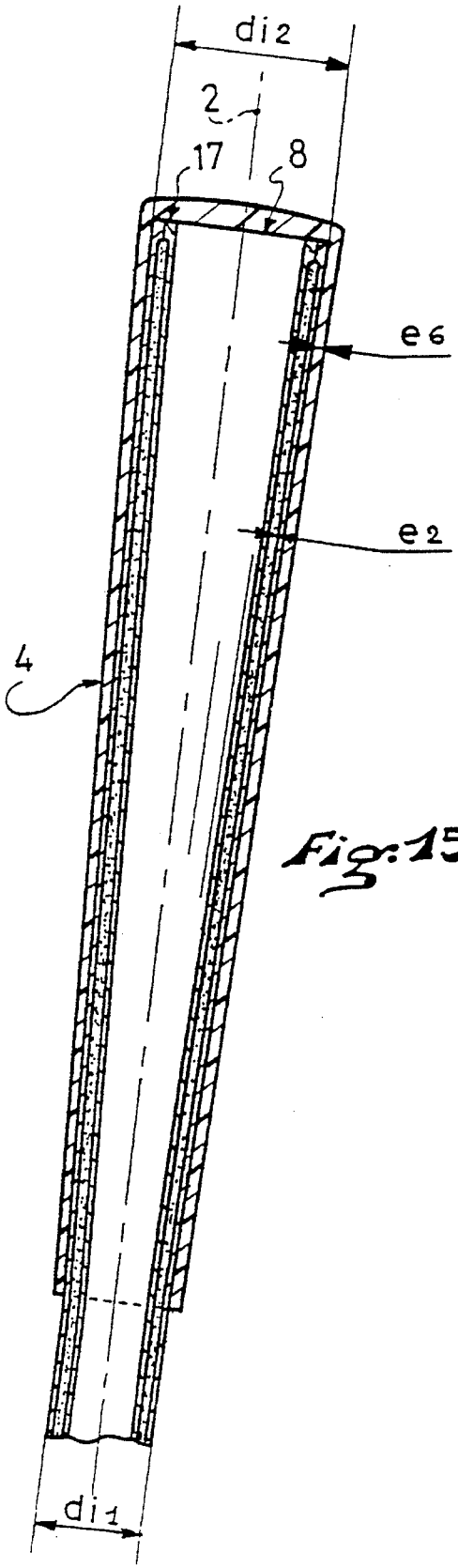
FIG. 15 is a mounting of a grip according to the invention.

The assembly of the shaft 1 with the grip 4 is done as shown in FIGS. 14 and 15.

FIG. 14 is a cross-section of the mounting of a conventional grip 4 on a classic shaft 1.

The external diameter dc of the shaft 1 is substantially constant over the length of the shaft 1 common with the grip 4. The thickness of the grip 4 varies from a relatively low value e4 to thicken until a value e5 that is greater than e4 in the vicinity of the butt 8. This known assembly where the grip 4 has a variable thickness is necessary to adapt to the hands of the player.

FIG. 15 shows the assembly of a grip 4 with a shaft 1 according to the invention.

The exterior diameter of the shaft 1 varies over its length common with the grip 4 of a value di1 to enlarge until a value di2 that is greater than di1 in the vicinity of the butt 8.

Along the grip 4, i.e., in the vicinity of the butt 8, the shaft 1 has a wall 17 of substantially constant thickness e2 and forms a cone that enlarges in the direction of the butt 8. The grip 4 has a thickness e6 substantially constant and thin, preferably comprised between 0.1 and 3 millimeters.

The assembly of the grip 4 with the shaft 1 according to the invention is possible because the structure of the peripheral wall 17 including the foam is resistant to the pressure exerted by the hands of the players while being sufficiently light so as not to harm a good balancing of the club 3.

The mounting has the advantage of being much lighter than a conventional mounting. The mass gained can be added to the head 5 of club 3.

Preferably, as was already the case of the side of the tip 9, the peripheral wall 17 of the tube 1 does not comprise foam on a portion of tube 1 of a length of 2–50 millimeters from butt 8. This arrangement avoids the problems of delamination, since the layers of composite material are directly affixed to each other.

In a general manner, each layer of composite material has a thickness comprised between 0.05 and 2 millimeters. Preferably, the thickness will be very close to 0.15 millimeters.

Each layer of foam has a thickness e3 comprised between 0.1 and 5 millimeters.

The thickness e3 of the foam must be understood as being a thickness in a shaft 1 in which the manufacturing is completed. It is quite possible that the thickness of the foam before manufacturing be greater than e3.

Indeed, a preferred process of manufacturing the shaft 1 described, for example, in French Patent Publication No. 2,670,120 consists of using a hollow mandrel and dipping it in a bath of an elastomer product to form a bladder around the mandrel. Then the different layers of materials are wound on the bladder around the mandrel. The assembly is introduced in a cast having the exterior shape of the shaft 1. Air is injected in the mandrel and diffuses through the openings of the mandrel to inflate the bladder. The pressure from the air presses the layers in the cast and compresses them on the walls. A curing causes the resin contained in the layers of carbon fiber to polymerize.

After the curing, the shaft 1 has its definitive shape and it is possible to remove it from the cast. The thickness of each layer remains constant.

The curing is done at a temperature close to 120° C. This is why the layer of foam 15 is preferably a polymethacrylic imide, which is a plastic material capable of preserving its chemical and mechanical properties after being subjected to curing at 120° C.

Other known modes of manufacturing that do not require curing are foreseeable, but more costly.

Of course, the invention is not limited to the embodiments thus described, and comprises all equivalent techniques that can enter into the scope of the claims that will follow.

Particularly, one can envision the construction of a shaft 1 comprising more than two layers of composite material and one layer of foam.

One can also provide a structure of the shaft 1 comprising several layers of composite material and several superposed layers of foam.

The instant application is based upon French Patent Application No. 95.01809, filed on Feb. 13, 1995, the disclosure of which is hereby expressly incorporated by reference thereto in its entirety and the priority of which is claimed under 35 USC 119.

Although the invention has been described with reference to particular means, materials, and embodiments, it is to be understood that the invention is not limited to the particulars expressly disclosed, but the invention extends to all equivalents within the scope of the claims that follow.

What is claimed is:

1. A golf club shaft comprising:

an elongated tube extending along an axis, the tube being demarcated by an exterior surface, an interior surface, a tip adapted to be affixed to a club head, and a butt adapted to be affixed to a grip, a predeterminate thickness separating the exterior surface from the interior surface to form a peripheral wall comprising several layers of materials, wherein on at least 30% of the length of the tube, the peripheral wall comprises at least two layers, a first layer made of a material with a density (ρ1) and a longitudinal Young's modulus (E1) and a second layer made of a material with a density (ρ2) and a longitudinal Young's modulus (E2), the first and second layers being separated by a separation layer made of a substantially isotropic material having a density (ρ3) and a longitudinal Young's modulus (E3), the densities (ρ1, ρ2) of the materials of the first and second layers being greater than the density (ρ3) of the material of the separation layer, the longitudinal Young's moduli (E1, E2) of the materials of the first and second layers being respectively greater than 20 GPa, and the longitudinal Young's modulus (E3) of the material of the separation layer being lower than 20 GPa.

2. A golf club shaft according to claim 1, wherein:

the densities (ρ1, ρ2) of the materials of the two layers are greater than 1.2 kg/dm$^3$, and the density (ρ3) of the material of the separation layer is lower than 1.2 kg/dm$^3$.

3. A golf club shaft according to claim 1, wherein:

in the vicinity of the butt, the tube has a wall of a substantially constant thickness and forms a cone that enlarges in the direction of the butt.

4. A golf club shaft according to claim 1, wherein:

in the vicinity of the tip, the tube has a wall whose thickness comprises only one or several layers of materials whose density is greater than 1.2 kg/dm$^3$.

5. A golf club shaft according to claim 1, wherein:

on at least one portion of the tube, the thickness of the layer of material whose density is lower than 1.2 kg/dm$^3$ varies.

6. A golf club shaft according to claim 2, wherein:

the materials whose densities (ρ1, ρ2) are greater than 1.2 kg/dm$^3$ are composite materials formed by carbon and resin fibers.

7. A golf club shaft according to claim 6, wherein:

each layer of composite material has a thickness comprised between 0.05 and 2 millimeters.

8. A golf club shaft according to claim 2, wherein:

the material whose density is lower than 1.2 kg/dm$^3$ is a foam layer of a plastic material.

9. A golf club shaft according to claim 8, wherein:

the plastic material is a polymethacrylic imide.

10. A golf club shaft according to claim 8, wherein:

the foam layer has a thickness comprised between 0.1 and 5 millimeters.

11. A golf club shaft according to claim 1, wherein:

the different layers forming the peripheral wall of the tube are glued on each other.

12. A golf club shaft according to claim 10, wherein:

on a side of the shaft to be affixed to a grip, the foam layer of the wall stops at a distance comprised between 2 and 50 millimeters from the butt.

13. A golf club shaft according to claim 10, wherein:

the foam layer is composed of at least two sections.

14. A golf club shaft according to claim 1, wherein:

the cross section of the shaft enlarges uniformly to form a convex portion.

15. A golf club shaft according to claim 1 wherein said shaft is affixed to a club head.

16. A golf club according to claim 15, wherein:

the shaft has a substantially conical shape enlarged on a side of the butt and including a grip, the low thickness (e6) of the grip is comprised between 0.1 and 3 millimeters.

* * * * *